US008212191B2

(12) United States Patent
Sopory et al.

(10) Patent No.: US 8,212,191 B2
(45) Date of Patent: Jul. 3, 2012

(54) HEATING CABLE WITH A HEATING ELEMENT POSITIONED IN THE MIDDLE OF BUS WIRES

(75) Inventors: Umesh Sopory, San Jose, CA (US); Wells Whitney, San Francisco, CA (US)

(73) Assignee: Thermon Manufacturing Co., San Marcos, TX (US)

( * ) Notice: Subject to any disclaimer, the term of this patent is extended or adjusted under 35 U.S.C. 154(b) by 1026 days.

(21) Appl. No.: 12/122,599

(22) Filed: May 16, 2008

(65) Prior Publication Data

US 2009/0283515 A1 Nov. 19, 2009

(51) Int. Cl.
*H05B 3/54* (2006.01)
*H05B 3/02* (2006.01)

(52) U.S. Cl. ..... 219/549; 219/546

(58) Field of Classification Search ..... 219/528, 219/529, 538–550
See application file for complete search history.

(56) References Cited

U.S. PATENT DOCUMENTS

| | | | | |
|---|---|---|---|---|
| 2,294,010 | A | 8/1942 | Van Dam | |
| 2,379,580 | A | 7/1945 | Hendley | |
| 2,581,212 | A | 1/1952 | Spooner et al. | |
| 3,538,482 | A | 11/1970 | Dugger | |
| 3,757,086 | A | 9/1973 | Indoe | |
| 4,037,083 | A | 7/1977 | Leavines | |
| 4,100,673 | A | 7/1978 | Leavines | |
| 4,459,473 | A * | 7/1984 | Kamath | 219/553 |
| 4,503,322 | A | 3/1985 | Kishimoto et al. | |
| 4,547,658 | A | 10/1985 | Crowley | |
| 4,631,392 | A | 12/1986 | O'Brien et al. | |
| 4,733,059 | A | 3/1988 | Goss et al. | |
| 4,816,649 | A | 3/1989 | Eilentroop | |
| 4,864,107 | A | 9/1989 | Boyal | |
| 5,245,161 | A | 9/1993 | Okamoto | |
| 5,422,462 | A | 6/1995 | Kishimoto | |

(Continued)

FOREIGN PATENT DOCUMENTS

JP 10-030260 A 2/1998

(Continued)

OTHER PUBLICATIONS

International Search Report and Written Opinion of ISR (from a corresponding foreign application), PCT/US2009/044234, both mailed Jan. 4, 2010.
International Search Report and Written Opinion of ISR (from a corresponding foreign application), PCT/US2009/044233,both mailed Jan. 11, 2010.
International Search Report and Written Opinion of ISR (from a corresponding foreign application), PCT/US2009/04432, both mailed Jan. 4, 2010.

*Primary Examiner* — Sang Paik
(74) *Attorney, Agent, or Firm* — Brian N. Young; Fountainhead Law Group P.C.

(57) ABSTRACT

Particular embodiments generally relate to a heating cable that includes a plurality of bus wires positioned on the outside of a heating element. In one embodiment, a spacer is provided. A heating element is included on a surface of the spacer. The heating element also includes one or more resistance wires. A plurality of bus wires are positioned on the edges of the spacer that has the heating element wrapped around it. For example, a first bus wire is positioned on a first side of the spacer and a second bus wire is positioned on a second side of the spacer. A plurality of node areas (e.g., on the bus wires or on an insulated heating element) allow a resistance wire of the heating element to be electrically coupled to the bus wires at the plurality of node areas on alternating bus wires.

13 Claims, 5 Drawing Sheets

U.S. PATENT DOCUMENTS

| | | | | |
|---|---|---|---|---|
| 6,005,232 | A | 12/1999 | Janvrin et al. | |
| 6,144,018 | A * | 11/2000 | Heizer | 219/529 |
| 6,288,372 | B1 | 9/2001 | Sandberg et al. | |
| 6,680,465 | B2 * | 1/2004 | O'Connor | 219/544 |
| 7,189,944 | B2 | 3/2007 | Child et al. | |
| 2002/0074328 | A1 | 6/2002 | O'Connor | |
| 2006/0089264 | A1 | 4/2006 | Hong | |
| 2006/0289476 | A1 | 12/2006 | O'Connor | |

FOREIGN PATENT DOCUMENTS

| | | |
|---|---|---|
| KR | 20-1999-0042175 | 12/1999 |
| KR | 20-0414017 Y1 | 4/2006 |

* cited by examiner

HEATING CABLE WITH A HEATING ELEMENT POSITIONED IN THE MIDDLE OF BUS WIRES

BACKGROUND

Particular embodiments generally relate to heating cables.

In cold environments, pipes may transport substances, such as oil, steam, and other process streams, etc. When steam or other process streams are transported through the pipes, the heat from the steam or process stream may help keep the pipes from freezing. However, if the system malfunctions, or if the flow of the process stream stops, and steam is not transported through the pipes, the steam condenses and the pipes may freeze. Accordingly, an electric heater may be used to keep the pipes warm to prevent freezing.

Different long-line heaters, generically called heat tracing products, may be used to keep the pipes warm. For example, all types of heaters are used. However, not all heaters may work well at high temperature. This is especially important when substances are transported at high temperatures in the pipes. Also, if the heater fails, then there is a large likelihood that the pipes may freeze and fail. This is a costly repair for a company and very undesirable. When manufacturing and installing the heaters, mechanical stress may be experienced. This may also damage the heaters and is undesirable.

SUMMARY

Particular embodiments generally relate to a heating cable that includes a plurality of bus wires positioned on the outside of a heating element. In one embodiment, a spacer is provided. A heating element is included on a surface of the spacer. For example, the heating element is wrapped around the spacer. The heating element also includes one or more resistance wires. A plurality of bus wires are positioned on the edges of the spacer that has the heating element wrapped around it. For example, a first bus wire is positioned on a first side of the spacer and a second bus wire is positioned on a second side of the spacer. If the spacer is rectangular in shape, the first and second bus wires may be placed on the sides of the rectangle or the top and bottom of the rectangle.

In one embodiment, the plurality of bus wires are insulated with an insulation jacket. A plurality of node areas in the bus wires expose portions of one or the other of the bus wires from the insulation. A resistance wire of the heating element may be electrically coupled to the nodes of the bus wires at the plurality of node areas on alternating bus wires.

In another embodiment, the heating element is insulated with an insulation jacket. A plurality of node areas in the heating element expose portions of the heating element from the insulation. A resistance wire of the heating element may be electrically coupled to the bus wire at the plurality of node areas on alternating bus wires. For example, the bus wires may be bare bus wires and couple to the resistance wires at the node areas.

An additional second insulating layer may surround the heating element and the bus wire structure. A metal sheath also may enclose the bus wire structure and the heating element. Further, a clip may be provided that is configured to wrap around the heating cable at a node to secure the electrical connection between the bus wires and the one or more resistance wires at the node. The clip includes a tab and an aperture, where the tab is inserted through the aperture to exert pressure against the one or more resistance wires to secure the electrical connection to one of the bus wires at the node area.

A further understanding of the nature and the advantages of particular embodiments disclosed herein may be realized by reference of the remaining portions of the specification and the attached drawings.

DETAILED DESCRIPTION OF EMBODIMENTS

Figure 1:
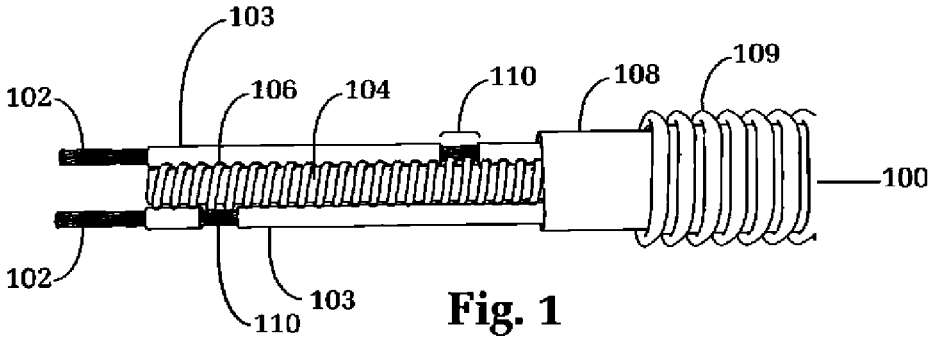
FIG. 1 depicts a heating cable according to one embodiment.

FIG. 1 depicts a heating cable 100 according to one embodiment. Heating cable 100 includes a heating element 106, a plurality of bus wires 102 and a spacer 104.

Spacer 104 may be various cross-sectional shapes, such as rectangular, square, circular, etc. Spacer 104 may be described as being substantially rectangular but it will be understood that substantially rectangular may be a 4 sided polygon. Spacer 104 may be made with an insulating material, such as from glass yarns wrapped around cloth tape made of glass cloth or mica. Spacer 104 may be different dimensions. In one embodiment, spacer 104 can be produced in larger dimensions to create a wider heating cable, which may be desirable to provide higher power outputs that can be distributed over a wider and larger surface area of the heating cable.

Heating element 106 may include an insulating core and one or more resistance wires wrapped around the core in a helical manner. Also, heating element 106 may just include the resistance wires without the core. Other variations of heating element will also be described below. Further, any number of heating elements 106 may be used to provide redundancy.

Heating element 106 is placed on an outer surface of spacer 104. For example, heating element 106 is wrapped around spacer 104 in a helical manner. Heating element 106 is placed on spacer 104 before bus wires 102 because bus wires 102 are placed on the outside of heating 106 and spacer 104.

The desired resistance to include in a node may be measured as heating element 106 is wrapped around spacer 104. The mechanical and physical arrangement of heating element 106 may be inspected before placing bus wires 102. This allows any quality issues to be addressed at an early stage of manufacturing of heating cable 100. For example, heating element 106 is wrapped around spacer 104 and can be inspected for any quality issues. The inspection is made before hiding it with bus wires 102 thus making it easy to notice imperfections or quality issues.

Bus wires 102 provide electrical power to heating zones. The bus wires may include round, stranded metal-coated copper conductors, flat, narrow bands of copper or other conducting metals, braided copper structures, or other structures that can provide electrical power. In one embodiment, two bus wires 102 are provided and are set parallel to one another. However, it will be understood that any other number of bus wires 102 may be used and can be arranged differently.

Heating element 106 may be insulated or not insulated. Also, bus wires may be insulated or bare. In one embodiment, first insulation layer 103 jackets each individual bus wire 102. First insulation layer 103 electrically separates bus wires 102 from resistance wires of heating element 106. First insulation layer 103 may include layers of glass cloth, braided glass fibers, mica sheets, high-temperature silicon gels and pastes, etc.

Bus wires 102 are then placed on the outside of heating element 106. For example, if spacer 104 is rectangular in shape, a first bus wire is placed on a first side of the rectangle and a second bus wire is placed on a second side. This forms a substantially rectangular structure. Also, the first and second bus wires may be placed on the top and bottom or spacer 104 to form a more circular structure. Bus wires 102 are placed such that heating element 106 is in between spacer 104 and each individual bus wire.

In one example, bus wires 102 are substantially flat. A flat bus wire creates a structure that is more round than oval (using stranded or round bus wires 102 cause a more oval shape to be formed). The round shape sometimes allows the structure to be inserted in metal sheath 109 easier in the field.

First insulation layer 103 may include bared areas that are referred to as nodes 110. The bared areas are where insulation has been removed to expose a portion of one of bus wires 102. Node 110 allows bus wires 102 to contact resistance wires of heating element 106. As will be described in more detail below, an electrical connection is formed at nodes 110.

Because heating element 106 is placed on spacer 104 before bus wires 102, the length of resistance wire that is wrapped around spacer 104 may be measured. The desired resistance in the zone may then be measured before baring first insulation layer 103 on bus wires 102 at points where zone boundaries are created. An accurate forming of node areas 110 may then be created where the zones are desired.

Second insulation layer 108 is wrapped around the heating element 106 and bus wires 102 to electrically insulate heating element 106 from the metal sheath that encloses it. Second insulation layer 108 may include layers of glass cloth tapes and mica/glass cloth tapes, or other suitable high temperature insulation materials.

Metal sheath 109 encloses the outside of the bus wires and heating element 106. Metal sheath 109 may protect bus wires 102 and heating element 106 from moisture ingress. Metal sheath 109 may be corrugated to allow flexibility. Accordingly, metal sheath 109 may afford an appropriate amount of mechanical and chemical protection to bus wires 102 and heating element 106. Materials used for metal sheath 109 may include stainless steel, incoloy alloys, inconel alloys, high-temperature aluminum, and other chemically-resistant steels. Other embodiments of metal sheath 109 may include a tape that is seam-welded on one side or both sides, a tape that has been slightly corrugated before welding, a tube, a slightly-flattened tube, a corrugated tube, and a slightly-flattened corrugated tube.

Figure 2:
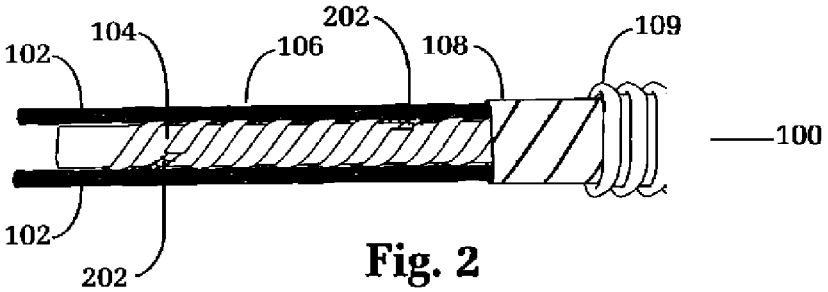
FIG. 2 depicts a heating cable with an insulated heating element according to one embodiment.

In another embodiment, heating element 106 may be insulated. FIG. 2 depicts a heating cable 100 with an insulated heating element 106 according to one embodiment. Also, bus wires 102 may be bare. Because heating element 106 is insulated, that is, the resistance wires 202 are insulated, insulation layer 220 is bared at certain node areas to expose a portion of the resistance wires. If heating element 106 is wrapped around spacer 104, the bared areas of heating element 106 allow the resistance wires to contact bus wires 102 at alternating positions. For example, heating element 106 contacts one bus wire and is then wrapped around to contact the other bus wire, and so on. This allows heating element 106 to electrically couple to bus wire 102. The baring of bus wires 102 allows electrical connections to be made at any point along the length of bus wires 102. This is in contrast to an insulated bus wire in which node areas would need to be formed to expose the bus wires.

Figure 3:
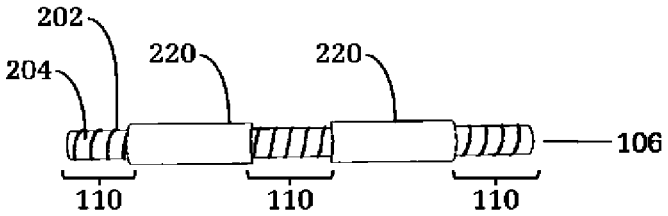
FIG. 3 depicts a more detailed example of the heating element of FIG. 2.

As shown in FIG. 3, resistance wires 202 may be wrapped around an insulating core 204 to form heating element 106. Heating element 106 is then wrapped around spacer 104. Various embodiments of heating element 106 will be appreciated and will be described below. For example, different numbers of resistance wires 202 may be included and wrapped around insulating core 204 in different manners. In one example, a single resistance wire 202 may be wrapped around insulating core 204. To provide redundancy, circuits may be used that tie resistance wires 202 together. Also, multiple resistance wires 202 may be wrapped around insulating core 204. These resistance wires 202 may overlap at certain points to provide redundancy. Also, they may be wrapped in the same direction but may include circuits that tie the two resistance wires 202 together. These different variations will be described in more detail below.

Heating element 106 may be insulated with a fibrous structure or the like. For example, an insulation layer 220 is shown that surrounds resistance wires 202 and insulating core 204. Insulating layer 220 may be bared at a plurality of node areas 110.

At spaced-apart intervals, the plurality of node areas 202 are formed by removing insulation 220. The conductive resistance wire 202 is exposed over a short distance. The insulated heating element 106 is wrapped around spacer. Electrical contact is made at the plurality of node areas 110 where resistance wires 202 have been exposed when bus wires 102 are placed on the outside of heating element 106. Bus wires are bare such that wherever bus wires 102 couple to node areas 110, an electrical connection is formed.

Further embodiments of heating cable 100 may be disclosed in U.S. patent application Ser. No. 12/122,594, entitled "HEATING CABLE WITH INSULATED HEATING ELEMENT" and U.S. patent application Ser. No. 12/122,592, entitled "HEATING CABLE", both of which are filed concurrently and incorporated by reference in their entirety for all purposes.

Figure 4:
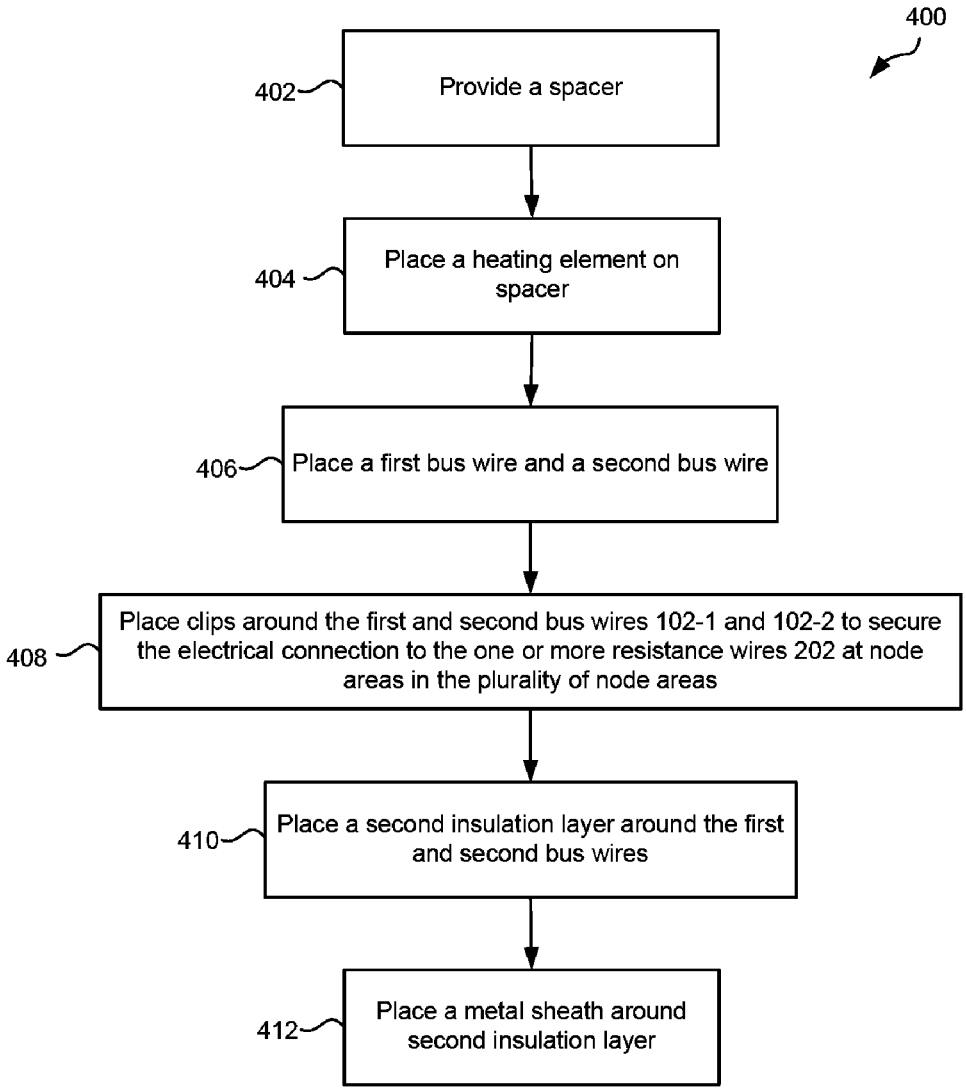
FIG. 4 depicts a simplified flowchart of a method of manufacturing a heating cable according to one embodiment.

FIG. 4 depicts a simplified flowchart 410 of a method of manufacturing a heating cable according to one embodiment. Step 412 provides spacer 104. Spacer 104 may be manufactured based on a desired width of heating cable 100.

Step 414 places a heating element 106 on spacer 104. Heating 106 may be wrapped around spacer 104. Also, heating element 106 includes one or more resistance wires 202 on a surface of insulating core 204.

Step 416 places a first bus wire and a second bus wire. The first bus wire 102-1 is positioned on a first side of spacer 104 and a second bus wire 102-2 is positioned on a second side of spacer 104 such that heating element 106 is in between the first bus wire 102-1 and spacer 104 and in between the second bus wire 102-2 and spacer 104.

Step 418 places clips around the first and second bus wires 102-1 and 102-2 to secure the electrical connection to the one or more resistance wires 202 at node areas in the plurality of node areas.

Step 420 places a second insulation layer 108 around the first and second bus wires 102-1 and 102-2. Step 422 then places a metal sheath 109 around second insulation layer 108.

Particular embodiments provide many advantages. For example, the resistance of a zoned heating element can be measured before laying the bus wires 102 along side spacer 104. This makes sure that the correct heat output will be achieved in the finished heating cable 100. Also, when a redundant design including multiple heating elements 106 wrapped around spacer 104 is used, all clips can be installed at the same time in the same process and spaced apart appropriately.

Different embodiments of heating element 106 will now be described. These embodiments describe redundancy schemes that may or may not be used. Heating element 106 may include an insulating core and one or more resistance wires wrapped around the core in a helical manner. In another embodiment, multiple heating elements 106 may be wrapped around the bus wire structure. For example, two heating elements 106 may be wrapped around the bus wire structure concurrently without touching each other. This may form a redundant design where two heating elements 106 are connected at intervals along the length of a zone where the insulating layer 220 has been bared. This provides additional redundancy.

Figure 5A:
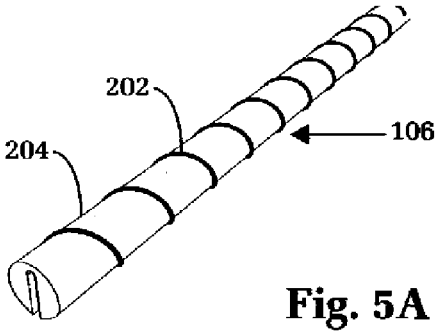
FIGS. 5A, 5B, and 5C depict examples of a heating element according to various embodiments.
Figure 5B:
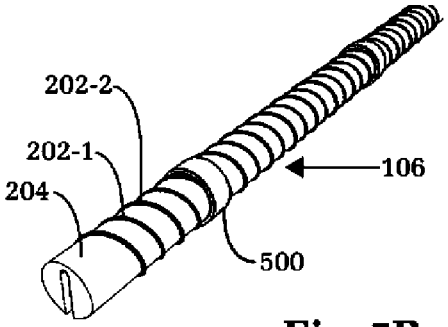
Figure 5C:
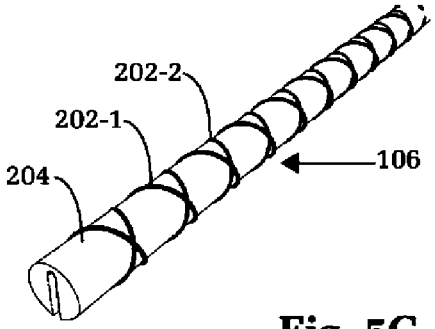

FIGS. 5A, 5B, and 5C depict examples of heating element 106 according to various embodiments. FIG. 5A shows an example of heating element 106 that includes a resistance wire 202 wrapped around an insulating core 204 according to one embodiment. Resistance wires 202 may include a metal wire, such as a fine gauge, high-resistance metallic alloy wire (Nichrome or Kanthol). In one example, 40 American wire gauge (AWG) resistance wire (e.g. Nichrome-60 wire, NiCr60 T-type 675 nickel chrome alloy) may be used. Also, different gauge resistance wires may be used (generally from about 4 mils down to 1 mil in diameter).

The insulating core may be a tape, such as a cloth tape made up of a glass material. The tape may be flat and a certain width, length, and height, such as tapes from ¼ to ½ inch width. The cloth tape is folded over to form insulating core 204. As will be described in more detail below, the tape when folded over is somewhat stiff and exerts an outward force because the tape wants to open up again. The tendency to open up maintains an outward force on resistance wire 202. Because resistance wire 202 is wound around insulating core 204, resistance wire 202 is kept taut and tight and is not able to move around or slip around insulating core 204. Thus, different sections of resistance wire 202 are prevented from touching each other.

The use of glass cloth tape also enables different width heating elements 106 to be made easily. For example, additional cloth tape may be wrapped around to form a thicker or thinner insulating core 204. By providing a different width insulating core 204, greater lengths of resistance wire 202 may be used per foot of heating element 106. For example, a thicker insulating core 204 allows more resistance wire 202 to be wrapped around it per square foot. This may be important when more resistance wire is desired per zone. Different combinations of spacing pitch of the wrapping of heating elements give different resistances and power output of the heating cable depending on applied voltages, as will be described in more detail below. Accordingly, flexibility is provided using the cloth tape in addition to providing an outward force to tightly wind resistance wires 202 around insulating core 204.

FIG. 5B shows two resistance wires 202-1 and 202-2 that are wrapped around insulating core 204 in the same direction. FIG. 5C depicts two resistance wires 202-1 and 202-2 wrapped around insulating core 204 in opposite directions. Other ways of wrapping resistance wires 202 may be appreciated. Wrapping resistance wire 202 in this manner provides redundancy, which allows a resistance wire to be cut or fail, but still allows a zone to be heated using redundancy. Other methods of providing redundancy using a circuit or wire may be used.

After wrapping resistance wires 202 around insulating core 204, heating element 106 then wraps around spacer 104 as shown in FIG. 1. A heating zone may be a zone in between nodes 110 that alternatively contact bus wires 102.

Resistance wire 202 may contact bus wire 102 at nodes 110. This provides an electrical connection between resistance wires 202 and bus wires 102. When a voltage is impressed on bus wires 102, resistance wire 202 generates heat. Thus, in between the zones, heat is produced on resistance wires 202.

The zone length of zone heaters using fine gauge resistance wire as a resistance element depends on the overall resistance between nodes 110. This depends on the resistance per unit length of resistance wires 202, its length within zones, and the amount of heat desired and voltage applied to bus wires 102. If a fine gauge resistance wire is about 42 AWG (0.0025 inch diameter), the resistance is about 100 ohms/foot of length, a length of fine gauge wire to produce 10 watts/foot of heater at 240 volts AC is necessarily very long (wire length=240*240/10*100=57.6 feet of fine gauge wire). Particular embodiments provide this length of fine gauge wire into a shorter length of heater. By wrapping resistance wires 202 around insulating core 204 to form heating element 106, and then wrapping heating element 106 around spacer 104, shorter zone lengths are provided. This is because the length of resistance wire needed in a zone is shortened by wrapping the resistance wire around insulating core 102 and then wrapping heating element 106 around the bus wire structure. For example, a zone length may be about 1 or 2 feet using particular embodiments. By providing shorter zone lengths, if a zone is cut, only a small part of the pipe may not be heated. Also, by wrapping heating element 106 helically around the bus wire structure, more resistance wire is used within a zone and may produce more heat.

Accordingly, resistance wire 202 can be wound around the glass cloth fabric such that the length of resistance wire 202 is several times the length of the insulating core. Resistance wire 202 may be wound around insulating core 204 and wound around another insulating core 204 to produce an even greater length of resistance wire and this process may be repeated again and again. Resistance wires 202 may be sewn into glass cloth fabric in a zigzag fashion. Also, resistance wires 202 can be woven into glass cloth fabric and then that glass cloth fabric can be cut on a bias to produce angled redundant long resistance wire paths between bus wires.

Figure 6A:
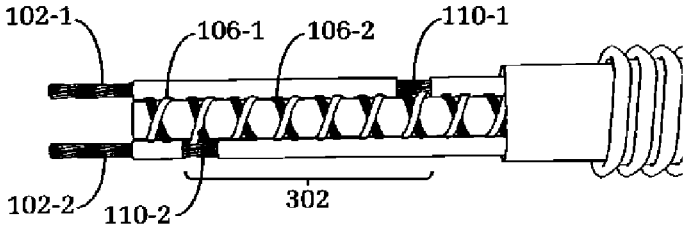
FIGS. 6A and 6B depict different embodiments of multiple heating elements wrapped around the bus wire structure according to one embodiment.
Figure 6B:
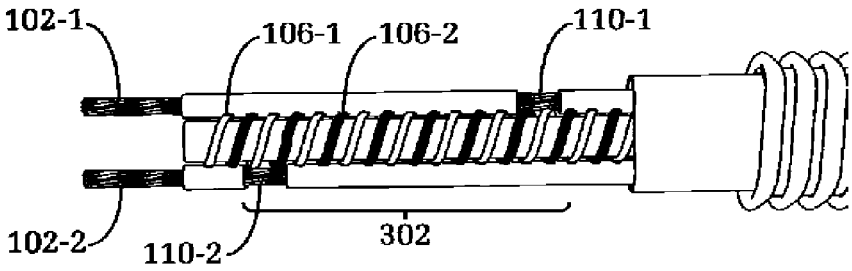

Particular embodiments also provide redundancy within zones, as long as the resistance wires and or the heating elements are electrically connected in some way within that zone. For example, FIGS. 6A and 6B depict different embodiments of multiple heating elements 106 wrapped around the bus wire structure according to one embodiment. According to embodiments, redundancy is provided in between zones 302 because if one resistance wire 202 is cut on one heating element 106, the other heating element 106 may still be functioning. For example, if a resistance wire 202 on heating element 106-1 is cut, it will not produce heat in between zone 302. However, if resistance wire 202 for heating element 106-2 has not been cut, then it still is electrically connected to nodes 110-1 and 110-2 and conducts heat. Thus, the heating cable still conducts heat in zone 302.

Further, as seen in FIG. 6A, heating element 106-1 and heating element 106-2 are overlapped in opposite directions. In FIG. 6B, two resistance wires 202 are wrapped in a co-rotating manner onto insulating core 204. Two resistance wires 202 may be substantially equally spaced apart along insulating core 204. In FIG. 6A, when resistance wires 202 are wrapped in opposite directions, they touch and make electrical contact at every place that they cross over and touch. This provides additional redundancy because electrical contact is continued at each overlapping point. If a resistance wire 202 is cut at one point, electrical contact at an overlapping point is re-established if the other resistance wire 202.

In FIG. 6B, when resistance wires 202 are wrapped in the same direction, then they do not overlap to make electrical contact, except at the ends at the node connections. However, ties may also be used to provide redundancy in between nodes. The ties provide electrical contact between multiple resistance wires. The ties may be wires that connect resistance wires 202 together electrically. Also, ties may be other connectors that are able to make electrical connections. A mechanical fastener may also be used that hold resistance wires 202 together and also provides electrical connection.

Figure 8A:
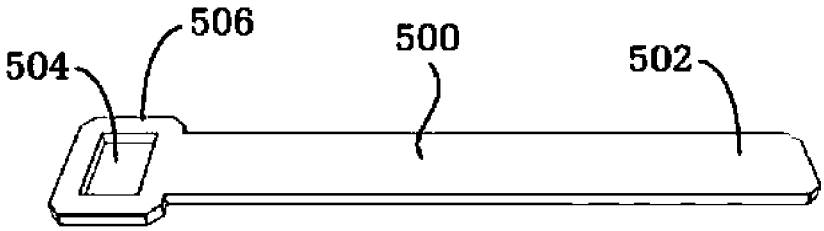
FIG. 8A depicts an example of a mechanical fastener that may be used to enhance the connection at a node according to one embodiment.

FIG. 8A depicts an example of a mechanical fastener that may be used to enhance the connection at node 110 according to one embodiment. Also, clip 500 (or other ties) may be used to connect resistance wires in between nodes 110. Clip 500 includes a tab 502 and an aperture 504. Aperture 504 is found in a head area 506. Also, clips may include staples, crimps, and spring-loaded jaws. Further, spot-welding, soldering or brazing, or other metal-to-metal bonding, such as wrapping wires around the entire bus wire structure, may be used.

If a good electrical connection is not made at nodes 110, then electrical contact may be disconnected physically. Also, if a good connection is not made, nodes 110 may become higher in contact resistance over time under the high temperature conditions during the use of the heating cable. High contact resistance at node 110 leads to poor electrical contact and/or voltage drop at that point that could destroy the contact and/or resistance wire at node 110 over time.

The many wraps of resistance wires 202 around insulating core 104 in heating element 106 and the long length of bus wires causes resistance wire 202 to contact bus wires 102 in many spots at each node 110. Using clip 500, the node may be encased and resistance wire 202 is held with firm physical contact onto bus wire 202.

Figure 8B:
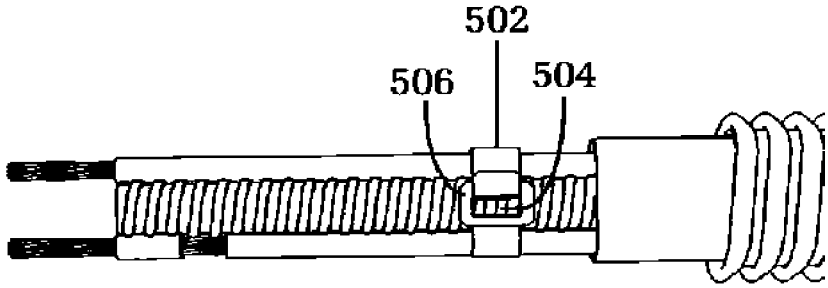
FIG. 8B shows a tie attached to the heating cable according to one embodiment.

FIG. 8B shows clip 500 attached to the heating cable according to one embodiment. As shown, tab 502 covers node 110. Clip 500 is kept in place by inserting an end of tab 502 through aperture 504 and bending the end of the tab over after pulling the tab tight. By bending the tab over, clip 500 is firmly attached to node 110. Clip 500 exerts force on resistance wires 202 against bus wires 102 to provide good electrical and physical contact. Clip 500 exerts pressure on resistance wires 202 because the end of tab 502 is inserted under the head 506 of clip 500 and then bent over above head 506. Because of this design, an inward force is exerted by the bending over of tab 502 on top of head 506 and thus provides firm pressure against resistance wires 202, which in turn provides good contact with bus wires 102.

Clip 500 provides many advantages of making electrical and physical contact over node 110. A wide area can be covered using clip 500 where resistance wires 202 touch bus wires 102. Further, the entire area of node 110 may be contacted to make contacts with all the resistance wires 202 that are contacting bus wire 102 in node 110.

The contact between bus wires 102 and resistance wires 202 should be a good both electrically and physically. The connection should be able to withstand high temperature and remain in good contact upon mechanical stress and cycling between low and high temperatures. The connection between resistance wires 202 and bus wires 102 can be made in various ways. For example, only physical contact may be provided between resistance wires 202 and bus wires 102 by wrapping heating element 106 around the bus wire structure. In one example, the folded glass tape may exert the outward force, which may provide a better electrical connection between resistance wires 202 and bus wires 102. For example, the outward force may cause resistance wires 202 to physically stay against bus wire 102. In the example shown in FIG. 6B, the use of clip 500 also connects heating elements 106-1 and 106-2 together by virtue of covering resistance wires 202 with a metallic tab. Thus, connections between resistance wires 202 of both heating elements 106-1 and 106-2 are provided. This provides redundancy in that if one resistance wire 202 is broken for heating element 106-1, with clip 500, the electrical connection may be continued as heating element 106-1 and 106-2 are connected together at a node 110. Thus, at most a zone may be lost due to a damaged heating element 106.

Accordingly, particular embodiments provide good mechanical and electrical contact between heating element 106 and bus wires 102 at nodes 110. This contact is maintained for design lifetime of the heating cable under mechanical and temperature extremes during the use of the heating cable.

Figure 7A:
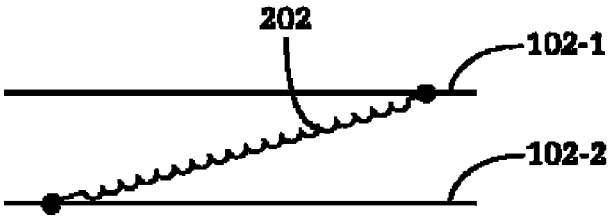
FIGS. 7A, 7B, and 7C depict examples of electrical circuits according to particular embodiments.
Figure 7B:
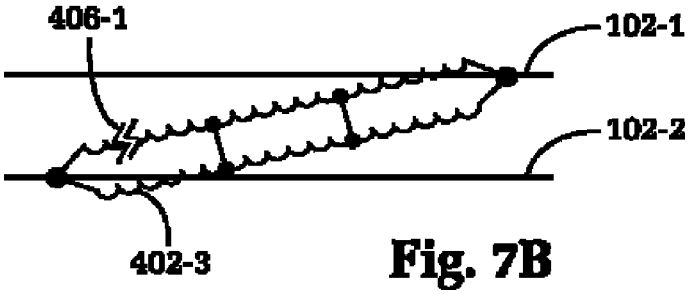
Figure 7C:
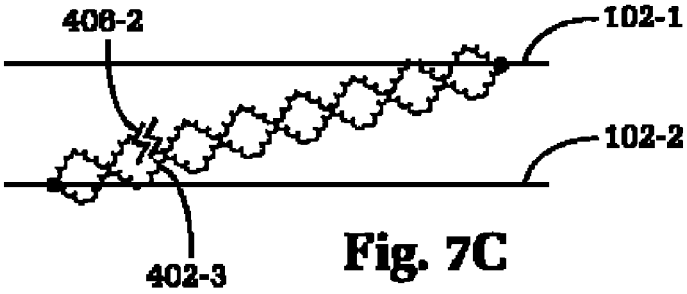

FIGS. 7A, 7B, and 7C depict examples of equivalent electrical circuits according to particular embodiments. The electric circuits are formed by heating element 106. A circuit provides redundancy if a break 404 occurs in resistance wire 202. For example, if a single resistance wire 202 is wrapped around insulating core 204, and if a break occurs in a resistance wire, then the zone will be broken if a circuit does not provide a different path.

As shown in FIG. 7A, if a break occurs on resistance wire 202, then a redundant path may not be provided. This prevents a continuous circuit to be formed during the break. However, in FIGS. 7B and 7C, redundancy is provided. For example, if a break 406-1 also occurs on resistance wire 202-2, another path may be provided to connect resistance wires 202 together. In this case, resistance wires 202-1 and 202-2 are connected together with ties. At the tie points, an electrical connection between resistance wires 202-1 and 202-2 is formed and current can flow through both wires 202.

In FIG. 7C, resistance wires 202-1 and 202-2 crisscross as described in FIG. 5C. At each point, an electrical connection is formed. When a break occurs, a path still exists on the other side of the circuit 402-3 and current can flow through both resistance wires 202 at the next overlap point.

Particular embodiments provide redundancy and reliability. For example, redundancy is provided in which resistance wires may be broken but alternate paths are provided such that the connection is not lost between zones. Also, good contact is provided at nodes due to a clip that holds resistance wires firm to bus wires 102 at nodes 110. Also, shorter zone lengths are provided because resistance wires 202 are wrapped around spacer 104. Thus, longer lengths of resistance wire may be wrapped around in a zone thus resulting in shorter zone lengths.

Accordingly, particularly embodiments reduce the danger of non-heated lengths of zones for a particular element that is being heated, such as a pipe. Redundancy, reliability, and shorter zone length provide a better heating cable.

In one embodiment, metal sheath 109 may be removed. A tape, such as glass fiber-mica tape, may be wrapped around heating element 106 and the bus wire structure. A metal braid layer then encloses the glass cloth insulation and then a high temperature polymeric jacket encloses the outer braid layer. The braid layer provides electrical protection and can be grounded and provides mechanical protection for the heating cable. The polymeric jacket material can withstand a long-term high temperature environment.

An example will now be discussed but it will be understood that other examples will be appreciated. Two heating elements 106 of medium length are wrapped in a co-rotated manner on spacer 104. There may be two electrical circuits 402, made by inserting ties between the heating elements, connecting heating elements 202 at one-third points between nodes 110. The heater produces 20 watts/unit length at 120 volts AC. By Ohm's Law, the total resistance between nodes is 720 ohms, each of the three sections having resistance of 240 ohms and producing 6.67 watts. The current flow through the heater is 0.278 amps.

If resistance wire 202 on each heating element 106 is made of 38AWG resistance wire with a resistance of 48 ohms/feet of wire length, then 16 feet of resistance wire is needed between nodes 110. If this resistance wire is wrapped around bus wires in a conventional zone heater configuration, then the zone length of the heater would be about 4 feet. However, particular embodiments may achieve a zone length of 1.33 feet by wrapping resistance wire 202 around insulating core 106. If two parallel resistance wires 202 are used, then the zone length may be doubled.

If one resistance wire 202 in one section of a heating element 106 is broken, then that section has resistance of 480 ohms and the other two sections still have resistance of 240 ohms each, and the sections are in series. Since total resistance is now 160 ohms, the current flow is 1.56 amps. The overall power output of the heater is now 15 watts, distributed as 7.5 watts in a section where the wire is broken and 3.75 watts in each of the other two sections. Though one resistance wire 202 has been broken, heat is still produced in all sections of a zone.

The above example is only an example and can be extended to additional redundant resistance wires 202 or heating elements 106 in parallel, as well as more electrical circuit ties between resistance wires 202. With increased parallel resistance wires 202, the distance between nodes 110 increases, however the inclusion of an increased number of electrical circuit ties between resistance wires 202 decreases the effective zone length of the heating cable. This can also apply to the counter-rotated wrapped resistance wires 202 which also contain redundancy and for which power output reduction on a break in the wire is minimal.

Although the description has been described with respect to particular embodiments thereof, these particular embodiments are merely illustrative, and not restrictive. For example, heating cable may be used to provide heat to a number of different structures and is not limited to pipes.

It will also be appreciated that one or more of the elements depicted in the drawings/figures can also be implemented in a more separated or integrated manner, or even removed or rendered as inoperable in certain cases, as is useful in accordance with a particular application. As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

Thus, while particular embodiments have been described herein, a latitude of modification, various changes and substitutions are intended in the foregoing disclosures, and it will be appreciated that in some instances some features of particular embodiments will be employed without a corresponding use of other features without departing from the scope and spirit as set forth. Therefore, many modifications may be made to adapt a particular situation or material to the essential scope and spirit.

We claim:

1. A heating cable comprising:

a spacer;

a heating element comprising:

an insulating core; and a plurality of resistance wires wrapped around the insulating core in a helical manner and coupled together at multiple points to provide redundant paths, the heating element positioned on an outer surface of the spacer and helically wrapped around the spacer;

a plurality of bus wires, wherein a first bus wire is positioned on a first side of the spacer and a second bus wire is positioned on a second side of the spacer such that the heating element is helically wrapped in between the first bus wire and the spacer and in between the second bus wire and the spacer, wherein:

the plurality of resistance wires are electrically coupled to the bus wires by coupling the plurality of resistance wires to the first or second bus wires at a plurality of node areas to create a plurality of resistance zones for generating heat, and the redundant paths via the plurality of resistance wires are provided in between two node areas to allow for current to flow in a resistance zone if one of the redundant paths is broken.

2. The heating cable of claim 1, further comprising a plurality of insulating jackets, wherein an insulating jacket encloses each of the plurality of bus wires, wherein the insulating jackets are bared at the plurality of node areas to expose portions of the first and second bus wires.

3. The heating cable of claim 1, further comprising an insulating layer surrounding the plurality of bus wires.

4. The heating cable of claim 3, further comprising a corrugated metal sheath enclosing the insulating layer, the corrugation providing flexibility to the heating cable.

5. The heating cable of claim 1, further comprising a clip configured to wrap around the plurality of bus wires at a node to secure an electrical connection between the first and second bus wires and the plurality of resistance wires at the node.

6. The heating cable of claim 1, wherein the spacer comprises layers of cloth tape.

7. The heating cable of claim 1, wherein the spacer is substantially rectangular.

8. The heating cable of claim 7, wherein the first bus wire and the second bus wire are positioned on opposite sides of the substantially rectangular spacer.

9. A method for manufacturing a heating cable, the method comprising:

providing a spacer;

placing a heating element comprising an insulating core and a plurality of resistance wires wrapped around the insulating core in a helical manner and coupled together at multiple points to provide redundant paths, wherein the heating element is positioned on an outer surface of the spacer and helically wrapped around the spacer; and placing a first bus wire and a second bus wire, wherein a first bus wire is positioned on a first side of the spacer and a second bus wire is positioned on a second side of the spacer such that the heating element is helically wrapped in between the first bus wire and the spacer and in between the second bus wire and the spacer, wherein:

the plurality of resistance wires are electrically coupled to the bus wires by coupling the plurality of resistance wires to the first or second bus wires at a plurality of node areas to create a plurality of resistance zones for generating heat, and the redundant paths via the plurality of resistance wires are provided in between two node areas to allow for current to flow in a resistance zone if one of the redundant paths is broken.

10. The method of claim 9, further comprising forming the plurality of node areas by removing insulation from insulating jackets of the first and second bus wires to expose the first or second bus wires.

11. The method of claim 9, further comprising placing an insulation layer around the first and second bus wires.

12. The method of claim 11, further comprising placing a corrugated metal sheath around the insulating layer, the corrugation providing flexibility to the heating cable.

13. The method of claim 9, further comprising placing a clip around the first and second bus wires to secure the electrical connection to the first or second bus wires at a node area in the plurality of node areas.

* * * * *